US006349578B1

(12) United States Patent
Tuvy et al.

(10) Patent No.: US 6,349,578 B1
(45) Date of Patent: Feb. 26, 2002

(54) LOCK ASSEMBLY ASSEMBLED WITHOUT A BOLT

(75) Inventors: Avraham Tuvy, Oakhurst; Michael P. DiLonardo, Toms River, both of NJ (US)

(73) Assignee: Antec Corporation, Duluth, GA (US)

( * ) Notice: Subject to any disclaimer, the term of this patent is extended or adjusted under 35 U.S.C. 154(b) by 0 days.

(21) Appl. No.: 09/370,283

(22) Filed: Aug. 9, 1999

(51) Int. Cl.[7] ..... B65D 55/14

(52) U.S. Cl. ..... 70/162; 70/DIG. 34; 70/466; 292/121; 292/128

(58) Field of Search ..... 70/57, 58, 63, 70/158–173, 451, 466, DIG. 27, DIG. 34; 292/99, 121, 122, 124, 126, 128, 198, 219, 220, 224, 228, 240–242, DIG. 51, DIG. 53, DIG. 59, DIG. 64

(56) References Cited

U.S. PATENT DOCUMENTS

| | | | | | |
|---|---|---|---|---|---|
| 197,531 | A | * | 11/1877 | Vetter | 70/466 X |
| 836,810 | A | * | 11/1906 | Kapus | 292/DIG. 20 X |
| 976,027 | A | * | 11/1910 | Beehler | 292/121 |
| 1,002,259 | A | * | 9/1911 | Goedeke | 292/121 |
| 1,022,576 | A | * | 4/1912 | Beehler | 292/121 |
| 1,758,361 | A | * | 5/1930 | Frost | 70/162 |
| 1,807,911 | A | * | 6/1931 | Garbell | 292/121 |
| 2,326,069 | A | * | 8/1943 | Samzelius | 292/128 |
| 2,794,664 | A | * | 6/1957 | Kruger | 292/99 X |
| 2,930,645 | A | * | 3/1960 | Dall | 292/121 X |
| 2,955,861 | A | * | 10/1960 | Claud-Mantle | 70/63 X |
| 4,326,395 | A | * | 4/1982 | DeRosa | 70/DIG. 34 X |
| 4,391,111 | A | * | 7/1983 | Marcy | 70/162 |
| 4,947,661 | A | * | 8/1990 | Yoshida | 70/57 |
| 5,345,795 | A | * | 9/1994 | James et al. | 70/162 X |
| 5,412,960 | A | * | 5/1995 | James et al. | 70/63 |
| 5,860,302 | A | * | 1/1999 | James | 70/63 |

FOREIGN PATENT DOCUMENTS

| | | | | |
|---|---|---|---|---|
| FR | 449773 | * | 1/1913 | 292/121 |
| FR | 1211983 | * | 3/1960 | 70/162 |

* cited by examiner

*Primary Examiner*—Suzanne Dino Barrett
(74) *Attorney, Agent, or Firm*—Troutman Sanders LLP; Wm. Brook Lafferty; Gerald R. Boss

(57) ABSTRACT

A lock assembly having a latch member that is held in position against a mounting plate by tabs extending from the mounting plate without requiring a bolt, thus allowing a bolt having a desired one of many different head patterns to be installed in the lock assembly at a later time. The mounting plate has at least two upwardly-extending tabs for connecting the latch member to the mounting member without the bolt, which can be inserted through aligned apertures in the mounting plate and latch member at a later time. Preferably, each tab has a first portion that extends upwardly a certain distance from the mounting plate, and a second portion that extends from the vertical portion. Preferably, the second portions of the tabs extend in opposite directions. A back portion of the latch member is placed on the mounting plate such that a first tab extends through an aperture in the back portion of the latch member and such that a second tab is located adjacent to a notch in the back portion of the latch member. The position of the latch member is then adjusted so that a part of the back portion of the latch member is slid under the second portion of each tab.

12 Claims, 5 Drawing Sheets

LOCK ASSEMBLY ASSEMBLED WITHOUT A BOLT

FIELD OF THE INVENTION

The invention relates generally to a lock, and more specifically, to a lock assembly for securing an enclosure containing communications equipment.

BACKGROUND OF THE INVENTION

In communications networks, such as telephone or cable television systems, various equipment is located in the field near the subscriber. This equipment is often housed within enclosures, such as pedestals. Pedestals are usually tubular shaped enclosures that are extend from the ground. Pedestals typically include a lock to preventing unauthorized access to the equipment housed within the pedestal.

The lock of a pedestal typically includes a bolt that rotates a latch. The bolt typically has a frustoconical head having a groove therein with a particular shape or pattern. A wrench having a protrusion corresponding to the pattern can be mated with the pattern in the head of the bolt to allow the bolt to be turned with the wrench to open the latch. The pattern in the head of the bolt prevents persons except those who possess the special wrench, such as a technician from a service provider, from opening the lock to access the equipment within the pedestal.

Different service providers often require different patterns for the bolt heads. The inventors of the present invention are aware of at least 13 different bolt head patterns used by various service providers. Although the bolt head patterns may differ, the other structural elements of the lock may remain the same. Manufacturing and assembling the lock with many different types of bolts adds undesirable complexity and expense to the manufacturing and assembly processes. Therefore, it would be advantageous to be able to make a lock that does not include the bolt, but that allows a bolt having a particular head pattern to be installed later, such as by the different service providers. This would allow the lock to be manufactured and assembled without having to install different bolts for each different service provider.

Unfortunately, assembling the lock without the bolt has drawbacks. Typically, locks include at least two parts which are connected by the bolt. If the bolt is removed, the two parts do not remain attached. This makes installation of the bolt at a later time much more difficult because the lock must essentially be reassembled to allow the bolt to be installed. Therefore, there is a need in the art for a lock that can be manufactured and assembled without a bolt and yet have the different parts of the lock remain intact such that a bolt having the desired head pattern can be inserted into the lock at a later time.

SUMMARY OF THE INVENTION

The present invention is directed to a lock assembly having a mounting plate and a latch member that is held in position against the mounting plate by tabs extending from the mounting plate. The mounting plate has at least two upwardly-extending tabs for connecting the latch member to the mounting member without a bolt, which can be inserted through aligned apertures in the mounting plate and latch member at a later time. Preferably, each tab has a first portion that extends upwardly a certain distance from the mounting plate, and a second portion that extends from the vertical portion. Preferably, the second portions of the tabs extend in opposite directions.

During assembly of the lock assembly, a back portion of the latch member is placed on the mounting plate such that a first tab extends through an aperture in the back portion of the latch member and such that a second tab is located adjacent to a notch in the back portion of the latch member. The position of the latch member is then adjusted so that a part of the back portion of the latch member is slid under the second portion of each tab. In this manner, the tabs hold the back portion of the latch member against the mounting plate without the need for the bolt.

The present invention is advantageous because it allows the lock assembly to be assembled such that a desired bolt, having one of many different head patterns, can be quickly and easily installed at a later time by simply inserting the shaft of the bolt through apertures which are in proper alignment because the latch member is held in the proper position against the mounting member by the tabs. In this manner, no reassembly of the locking assembly is required to install the bolt at a later time.

DETAILED DESCRIPTION

Figure 1:
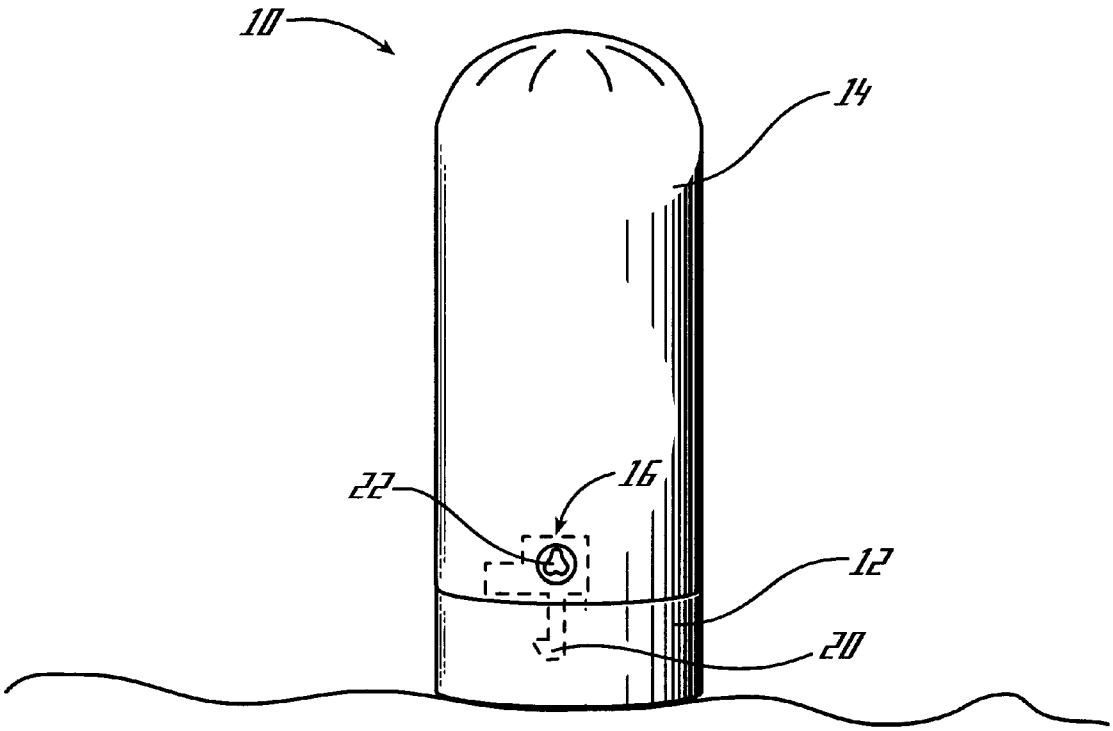
FIG. 1 is a perspective view of a pedestal having a lock therein for preventing access to communications equipment housed within the pedestal.

The present invention is a lock assembly that can be used in connection with any lock for which it is desired to hold two components together without the use of a bolt. The present invention can be used, for example, with an enclosure for housing communications equipment at or slightly above ground level. An example of such an enclosure is the pedestal 10 as shown in FIG. 1. Such pedestals typically have at least two portions, with a base portion 12 resting on the ground and a cap portion 14 removably connected to the base portion. A lock may be provided to prevent the unauthorized removal of the cap portion 14 from the base portion 12. The lock may include a lock assembly 16 connected to the inside of the cap portion and a catch member (not shown) attached to the inside of the base member. As will be understood by those skilled in the art, the lock assembly 16 includes a latch 20 that engages the catch member when the cap portion is lowered onto the base portion. The latch 20 on the lock assembly can be disengaged from the catch member by rotating a bolt 22 that extends from the lock assembly through an aperture in the cap portion of the pedestal.

Figure 2:
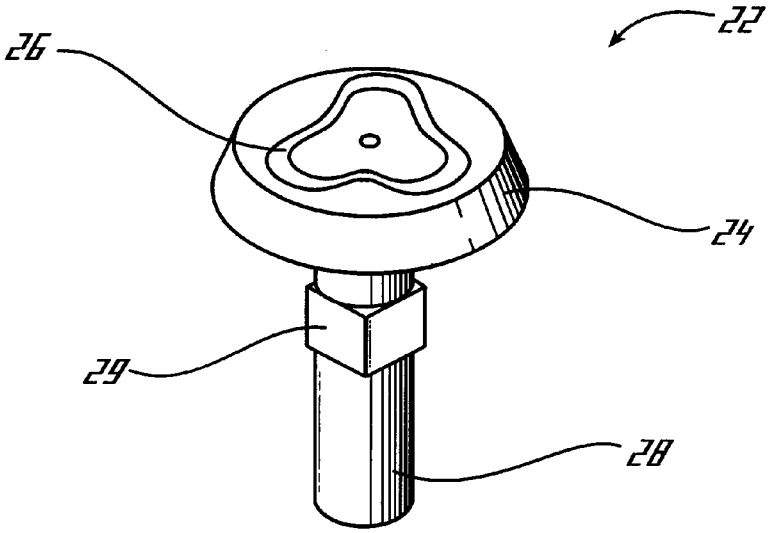
FIG. 2 is an example of a bolt used with the lock assembly of the present invention.

A typical bolt used in connection with the lock assembly is shown in FIG. 2 and is well known in the art. The bolt 22 typically has a frustoconical head 24 with a groove 26 therein having a special shape or pattern to allow the bolt to be turned only by someone, such as service provider personnel, who has a wrench having a protrusion corresponding to the special groove pattern. The bolt also has a shaft 28, at least a portion of which is non-circular in cross-section, as indicated by reference numeral 29.

Figure 3A:
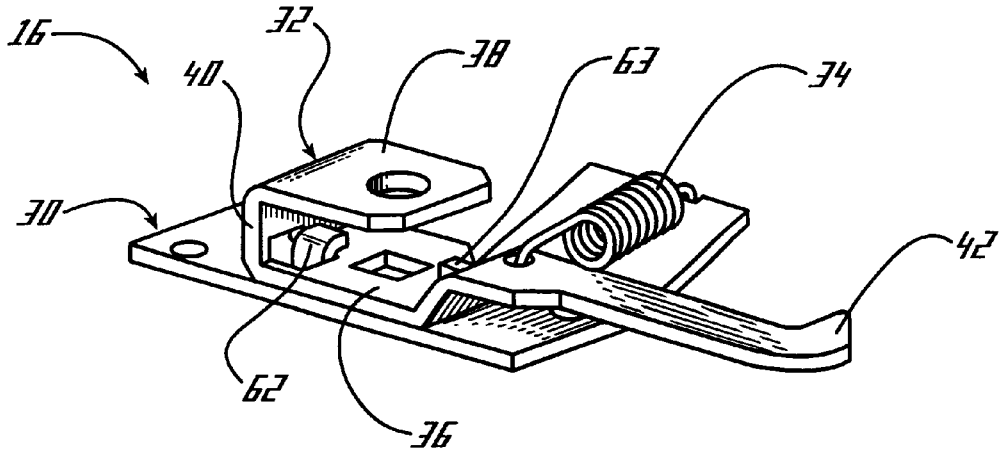
FIGS. 3A–C are a perspective, side, and plan view, respectively, of the lock assembly in accordance with the present invention.
Figure 3B:
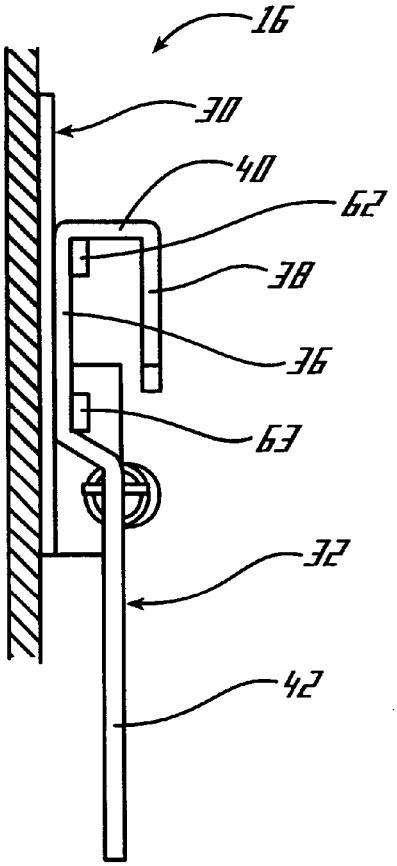
Figure 3C:
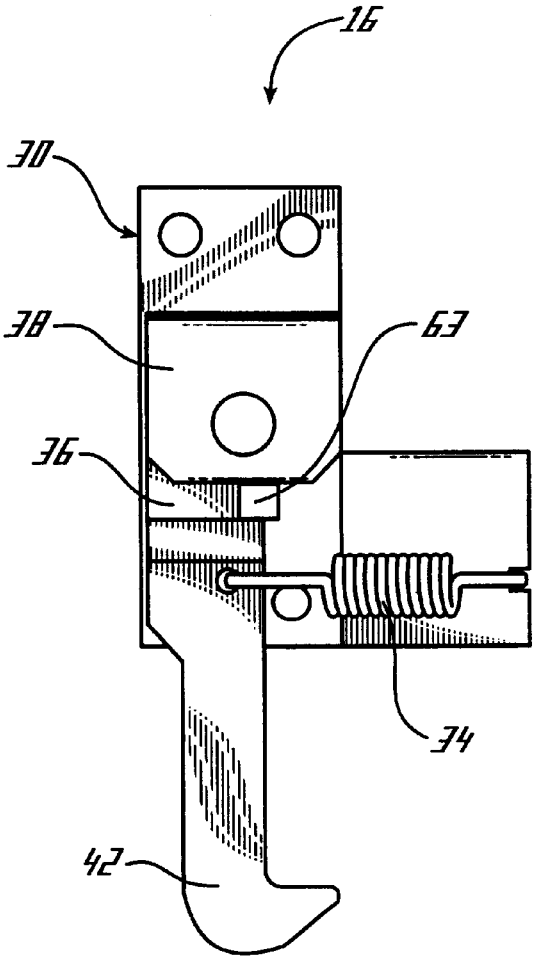

The lock assembly 16 according to the present invention is shown in FIGS. 3A–C. The lock assembly includes mounting member 30, which is attached to the inside of the cap portion of the pedestal as shown in FIG. 3B. The lock assembly also includes latch member 32 and spring member 34, which is connected between mounting member 30 and latch member 32 to bias the latch member to the position as shown in FIGS. 3A–C.

Figure 4A:
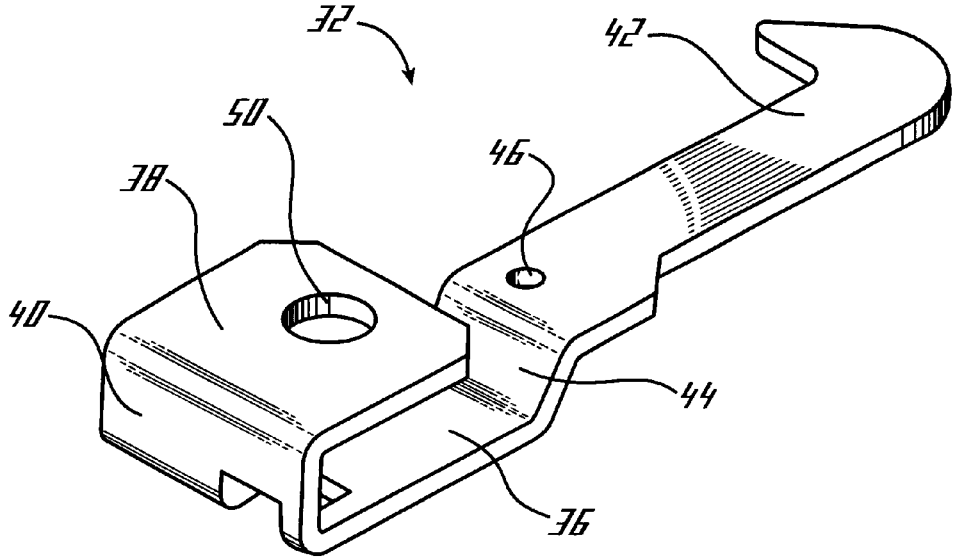
FIGS. 4A–C are two perspective views and a back view, respectively, of the latch member in accordance with the present invention.
Figure 4B:
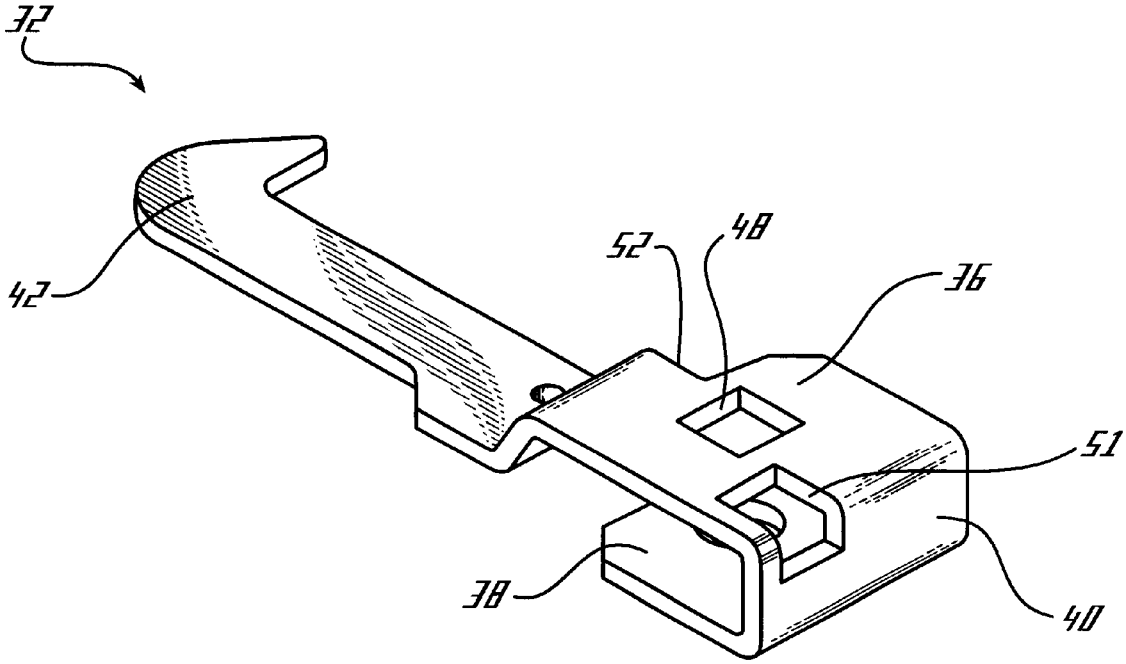
Figure 4C:
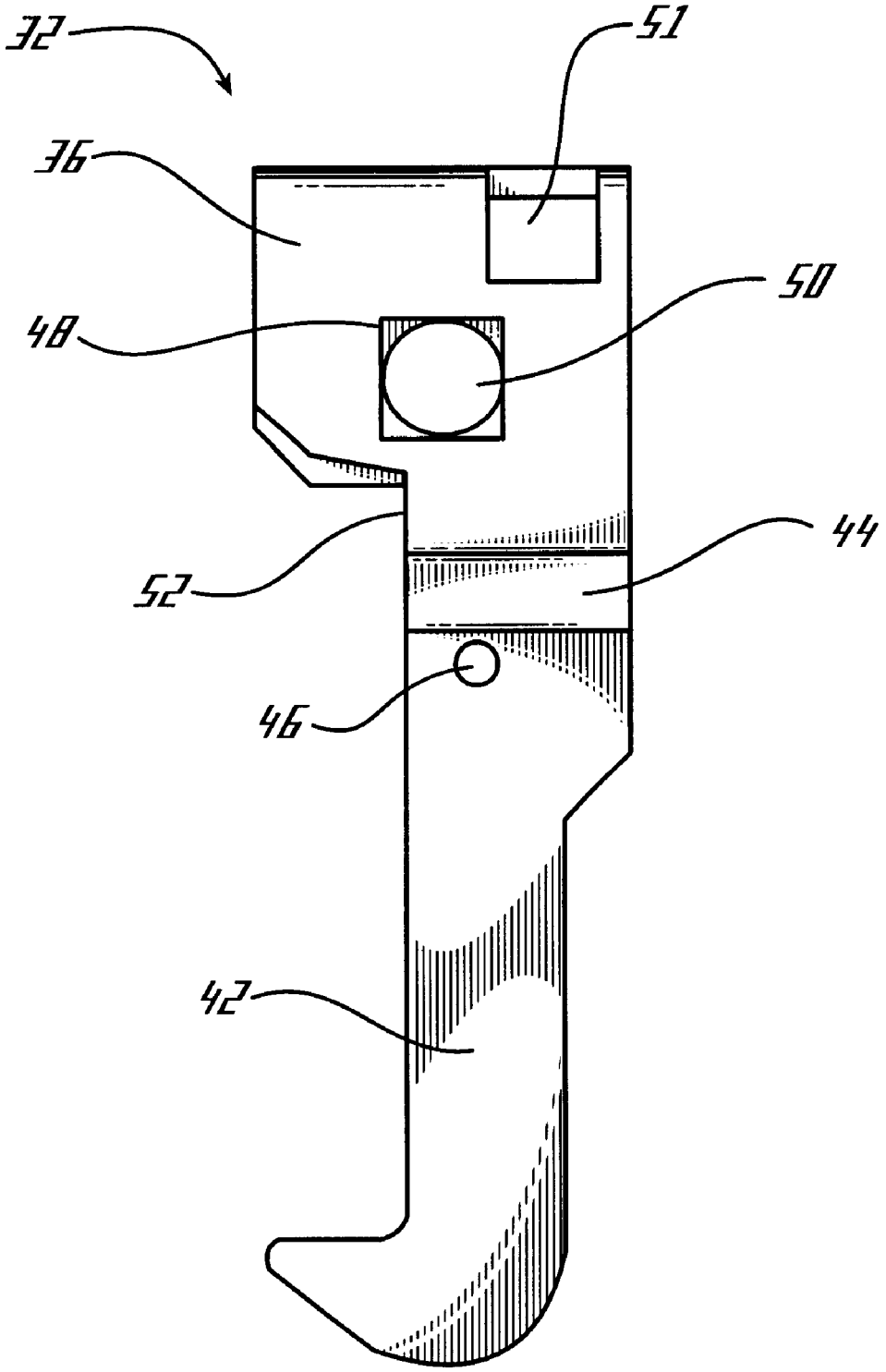

Latch member 32 is further shown in FIGS. 4A–C. Latch member 32 includes a back portion 36 and a front portion 38 connected by a vertical connector portion 40. The latch member also includes hook portion 42 connected to the back portion by connector portion 44. Hook portion 42 includes aperture 46 to which one end of spring member 34 is attached.

The back portion 36 of latch member 32 includes an aperture 48, and the front portion 38 includes an aperture 50. Both apertures are aligned to accept the shaft of a bolt that is inserted therethrough. At least one of the apertures, preferably aperture 48, is non-circular to correspond with the non-circular portion 29 of the bolt shaft so that when the bolt is rotated, the non-circular portion 29 of the bolt shaft in aperture 48 causes latch member 32 to rotate with the bolt.

Another aperture 51 is provided in the back portion, as best shown in FIG. 4B. A notch 52 is also provided adjacent to the connector portion 44 on the back portion.

Figure 5:
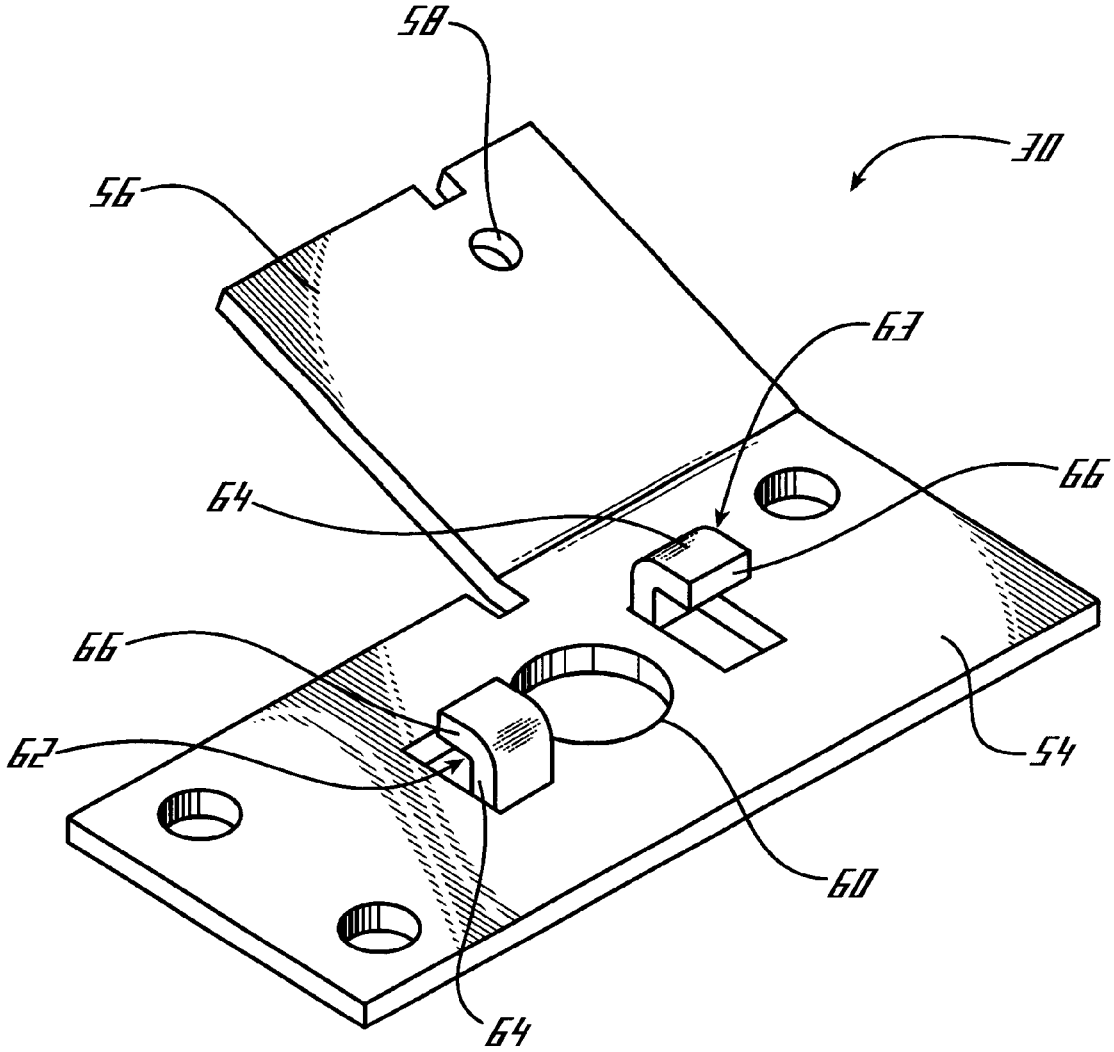
FIG. 5 is a perspective view of the mounting member in accordance with the present invention.

Mounting member 30 is best seen in FIG. 5, and includes a mounting plate 54 and a spring connector member 56 extending upwardly and to the side of the mounting plate. Spring connector member 56 has an aperture 58 to which the second end of spring member 34 is attached. Mounting plate 54 has an aperture 60 that is aligned with the apertures in the latch member for allowing a bolt to be inserted therethrough. When the bolt is inserted into the lock assembly, the bolt is inserted through aperture 60 in the mounting plate, and then through apertures 48 and 50 in the latch member. A securing washer or other suitable means is then applied to the end of the shaft of the bolt to secure the bolt within the apertures, thereby securing the latch member 32 to the mounting plate 54. It will be understood by those skilled in the art that the bolt may only need to be inserted through aperture 60 and 48 and then secured, without being inserted through aperture 50 in the latch member.

In existing locking devices, there is no way to attach the latch member to the mounting member without the bolt. Therefore, if a lock assembly is assembled without a bolt, as is desired when different service providers wish to use bolts with different head patterns that are to be installed after the initial assembly of the locking assembly, prior devices would not maintain the latch member in the proper position relative to the mounting member. In actuality, if the lock assembly of existing devices is assembled without the bolt, they would fall apart.

To solve this problem, in accordance with the present invention, the mounting plate 54 has at least two upwardly-extending tabs 62 and 63. Preferably, each tab has a first portion 64 that extends upwardly a certain distance from the mounting plate and a second portion 66 that extends from the vertical portion. Preferably, the second portions of the tabs extend in opposite directions, as shown in FIG. 5.

The function of the tabs is best described with reference to FIGS. 3A–C. The tabs permit the latch member to be connected to the mounting member without requiring a bolt to hold them together. During assembly of the lock assembly, the back portion 36 of latch member 32 is placed on the mounting plate 54 of mounting member 30 such that tab 62 extends through aperture 51 of the latch member and such that tab 63 is located adjacent to notch 52 in the back portion of the latch member. The position of the latch member is then adjusted so that a part of the back portion of the latch member slides under the second portion of each tab. This is best seen in FIGS. 3A–B. In this manner, tabs 62 and 63 hold the back portion of the latch member against the mounting plate without the need for the bolt. The tabs also act as stops for the latch member as it is biased by the spring member 34. Although the tabs hold the latch member against the mounting member, the tabs do not prevent the latch member from being rotated against the biasing force of the spring member when the bolt is installed and is rotated to unlock the lock.

It will be understood that the location of the tabs on the mounting plate, and the aperture and notch at corresponding locations on the back portion of the latch member, as described herein and shown in the attached figures, are only an example of the implementation of the present invention. The tabs may be located at any other suitable location, and the latch member may be constructed in any suitable manner to allow the tabs to hold the latch member against the mounting plate. Therefore, many variations of the present invention as contemplated by the inventors without departing from the spirit and scope of the present invention.

The present invention is advantageous because it allows the lock assembly to be assembled such that the desired bolt, having one of many different head patterns, can be easily and quickly installed at a later time by simply inserting the shaft of the bolt through the apertures which are in alignment because the latch member is held in the proper position against the mounting member by the tabs. In this manner, no reassembly of the locking assembly is required in order to install the desired bolt.

While the preferred embodiments of the invention have been shown and described, it will be obvious to those skilled in the art that various modifications and alterations can be made thereto without departing from the spirit and scope of the invention as defined in the appended claims.

What is claimed is:

1. A lock assembly, comprising:

a removable bolt having a shaft;

a mounting member having an aperture therein for receiving said shaft of said removable bolt;

at least two tabs extending from said mounting member;

a latch member having a front portion and a spaced parallel back portion, each said portion with an aperture therein for receiving said shaft of said removable bolt, said apertures of said front and back portions of said latch member aligned with one another to permit at least one of said apertures in said front and back portions to removably accept said shaft of said removable bolt;

wherein said lock assembly is assembled by connecting said latch member to said mounting member, without inserting said removable bolt through any of the apertures, by positioning a portion of said back portion of said latch member under each said tab.

2. The lock assembly of claim 1 wherein each said tab includes a first portion and a second portion with the second portion being spaced a predetermined distance from the mounting member, said predetermined distance being sufficient to allow said back portion of said latch member to be positioned between said second portion of each said tab and said mounting member.

3. The lock assembly of claim 2 wherein said first portion is generally perpendicular to said mounting member and said second portion is generally parallel to said mounting member.

4. The lock assembly of claim 2 wherein the second portions of each said tab face in opposite directions.

5. The lock assembly of claim 1 wherein said aperture of said back portion of said latch member at least partially surrounds at least one tab.

6. The lock assembly of claim 1 wherein said lock assembly further comprises a spring member connected between said latch member and said mounting member to bias said latch member in a first position, and wherein said tabs act as a stop to maintain said latch member at the first position.

7. The lock assembly of claim 6 wherein said latch member can be rotated away from said tabs when said bolt is inserted through the apertures in said mounting member and said latch member.

8. The lock assembly of claim 1 wherein the apertures in said mounting member and said latch member are aligned such that said bolt can be inserted through each aperture after said latch member is connected to said mounting member without the need for reassembling said lock assembly.

9. The lock assembly of claim 8 wherein said bolt has a head with a groove therein having a special pattern.

10. The lock assembly of claim 1 wherein at least one of said apertures in said latch member is non-circular and shaped to correspond with a non-circular portion of said shaft of said removable bolt.

11. A lock assembly for locking an enclosure that houses communications equipment therein, comprising:

a removable bolt having a shaft;

a mounting member for mounting to said pedestal having an aperture therein for receiving said shaft of said removable bolt;

at least two tabs extending from said mounting member;

a latch member having a front portion and a spaced parallel back portion, each said portion with an aperture therein for receiving said shaft of said removable bolt, said apertures of said front and back portions of said latch member aligned with one another to permit at least one of said apertures in said front and back portions to removably accept said shaft of said removable bolt;

wherein said latch member is connected to said mounting member, without inserting said removable bolt through any of the apertures, by positioning a portion of said back portion of said latch member under each said tab.

12. The lock assembly of claim 11 wherein said enclosure is a pedestal having at least two portions.

* * * * *